United States Patent [19]

Allen

[11] Patent Number: 5,060,951

[45] Date of Patent: Oct. 29, 1991

[54] METAL HEADED GOLF CLUB WITH ENLARGED FACE

[76] Inventor: Dillis V. Allen, 31W211 Route 58, Elgin, Ill. 60120

[21] Appl. No.: 665,156

[22] Filed: Mar. 6, 1991

[51] Int. Cl.[5] ..... A63B 53/04

[52] U.S. Cl. ..... 273/167 H; 273/167 J; 273/169

[58] Field of Search ..... 273/167 H, 169, 170, 273/171, 167 J, 167 R, 167 E, 167 F, 173, 174, 175, 77 R, 77 A

[56] References Cited

U.S. PATENT DOCUMENTS 3,847,399 11/1974 Raymont ..... 273/169 X
4,762,322 8/1988 Molitor et al. ..... 273/167 H X
4,930,781 6/1990 Allen ..... 273/167 F

*Primary Examiner*—George J. Marlo

[57] ABSTRACT

A "jumbo" metal wood having a metallic thin walled head including a face wall having a height of at least 1.625 inches designed to enlarge the sweetspot in greater proportion than the increase in face wall area, with a thin perimeter wall surrounding the face wall. The larger face wall is achieved without sacrificing face wall strength and without an increase in weight by a unit cellular structure integrally cast with and extending rearwardly from the face wall. The cellular structure has cells surrounded by other cells each bounded by thin walls including outer cells bounded in part by the perimeter wall.

9 Claims, 2 Drawing Sheets

METAL HEADED GOLF CLUB WITH ENLARGED FACE

RELATED PATENTS

This case is related to my U.S. Pat. Nos. 4,930,781 issued June 5, 1990, D314,029 issued Jan. 22, 1991, and D314,220 issued Jan. 29, 1991.

BACKGROUND OF THE INVENTION

A major problem in the design and manufacture of investment cast metal woods is the requirement the head weight be maintained between 195 to 208 grams depending on the weight of the attached shaft assembly. This weight range is necessary to yield swing weights in the range of C-9 to D-3.

To approach this weight range in stainless steel or other similar specific gravity metals it is necessary to cast the face wall no greater than 0.125 inches and the perimeter walls averaging no more than about 0.040 inches. This is no small task. For the perimeter walls to average 0.040 inches, the inherent inaccuracies in investment casting dictate that the perimeter wall in spots diminish to 0.020 inches or less. Since the head must be ground and polished after casting and since many areas of the head have artwork, graphics and text on the order of 0.010 to 0.018 inches in depth, the 0.020 inch minimum wall thickness is in many cases unacceptably too thin, resulting in part rejection or subsequent wall failure.

To ameliorate this problem reinforcing techniques have been developed for the forward wall that permit the forward wall to be made lighter and the perimeter walls heavier to not only eliminate the manufacturing problem of excessively thin outer walls but also to enhance the perimeter weighting of the head.

The landmark contribution to this technology is found in the Raymont, U.S. Pat. No. 3,847,399, assigned to the assignee of the present invention. Mr. Raymont discovered that by providing a honeycomb structure behind the forward wall, perimeter weighting was enhanced and a lighter and reinforced face could be produced.

In the Allen, U.S. Pat. No. 4,930,781, also assigned to the assignee of the present invention, a similar honeycomb reinforcement is used in an investment cast metal wood to rigidify the face to reduce face deflection so a more uniform deflection pattern could be achieved across the face.

The object of the present invention is to enlarge the sweetspot on the club face, not just by increasing perimeter weighting although such exists, by enlarging the club face area.

I have found that by increasing the total area of the face wall that the sweetspot area on the face increases at a rate far greater than the increase in overall face area.

Partitionings in golf club heads for various reasons are shown in the Marker, U.S. Pat. No. 1,592,463; the Tobia, U.S. Pat. No. 1,658,581; the Drevitson, U.S. Pat. No. 1,678,637; the Schaffer, U.S. Pat. No. 2,460,435; the Curley, U.S. Pat. No. 2,592,013; the Mader, U.S. Pat. No. 4,021,047; the Nygren, U.S. Pat. No. 4,076,254; the Zebelean, U.S. Pat. No. 4,214,754; the Motomiya, U.S. Pat. No. 4,438,931; the Hayashi, et al., U.S. Pat. No. 4,449,707; the Yamada, U.S. Pat. No. 4,535,990; the Teramoto, et al., U.S. Pat. No. 4,645,207; the Straza, et al., U.S. Pat. No. 4,679,792; the Chen, et al., U.S. Pat. No. 4,681,321, and the Tilley, U.S. Pat. No. 4,730,830.

There have also been attempts to provide club heads with rear covers, such as shown in the Nero, U.S. Pat. No. 1,825,244, and the Carlino, U.S. Pat. No. 3,637,218, but these attempts have not been applied to thin walled investment cast club heads, and are thus not directed to any of the problems in that casting art.

It is a primary object of the present invention to provide a metal wood with a larger sweetspot by enlarging the face wall area without increasing head weight or sacrificing head strength.

SUMMARY OF THE PRESENT INVENTION

In accordance with the present invention a thin-walled cast head is provided for a metal wood that has an enlarged face wall that provides a greater sweetspot increase than total face area increase.

Heretofore, face wall area increase was not possible with investment cast metal wood heads because it meant an unacceptable increase in head weight. And in investment cast metal woods the face wall is always thickest and hence the heaviest. So enlarging the face wall in accordance with the prior art meant a significant increase in head weight.

According to the present invention, a larger face wall has become possible by utilizing a reinforcing structure, formerly used to increase perimeter weighting or reduce face deflection, to enlarge the face wall without increasing total face wall weight. Since face wall weight remains about the same, compared to a flat back sided thicker face wall on a smaller conventional metal wood, the overall head weight remains within the acceptable limits.

The reinforcing structure permits the club face size to be increased up to 20% without a significant increase in weight, and what is more surprising is the sweetspot increases even more than 20%.

To achieve this disproportionate benefit, the unit cellular structure should have at least two cells surrounded by other cells, and preferably more, bounded by boundary walls including outer cells bounded in part by the perimeter wall surrounding the face. These walls act as "T" beams in reinforcing the face so the walls must be relatively thin in a plane parallel to the face wall to achieve any significant weight saving.

Other objects and advantages of the present invention will appear from the following detailed description.

DETAILED DESCRIPTION OF THE PREFERRED EMBODIMENT

Figure 1:
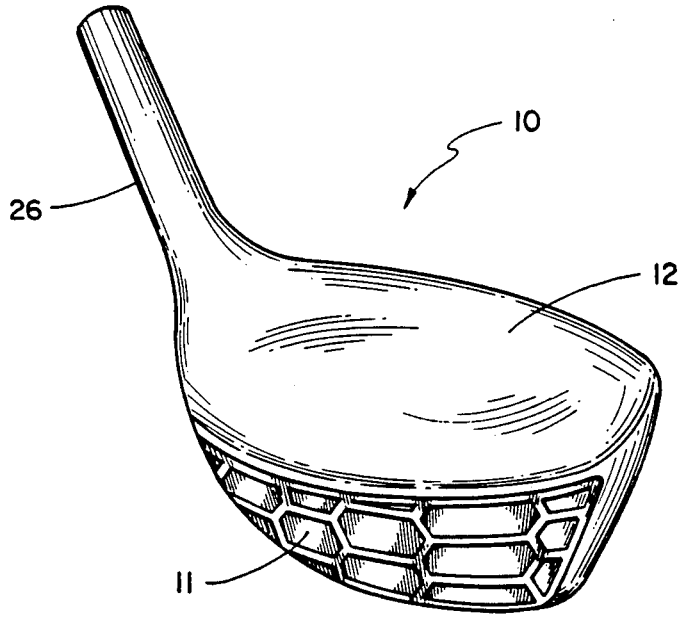
FIG. 1 is a perspective view of a club head according to the present invention.
Figure 2:
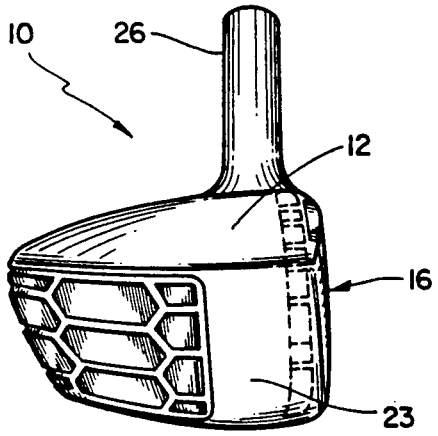
FIG. 2 is a left side view of the club head illustrated in FIG. 1.

Referring to the drawings and particularly the embodiment illustrated in FIGS. 1 to 10, an investment cast stainless steel club head 10 is illustrated having a substantially conventional outer appearance except for a graphics engraved area 11 on the rear of the club. It should be understood that the outer appearance of club 10 is covered in my U.S. Design Patents referred to above in the Related Patents section of this application.

Figure 8:
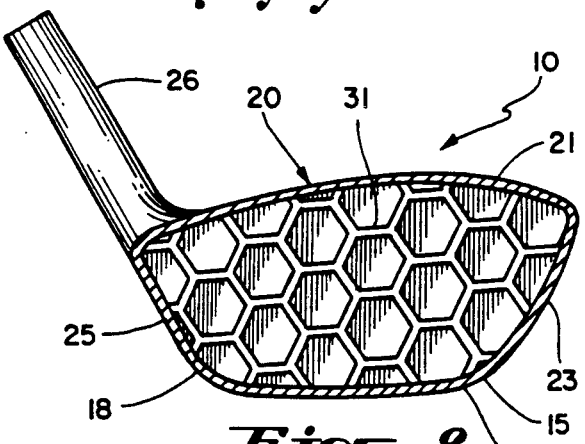
FIG. 8 is a cross section taken generally along line 8—8 of FIG. 7.
Figure 9:
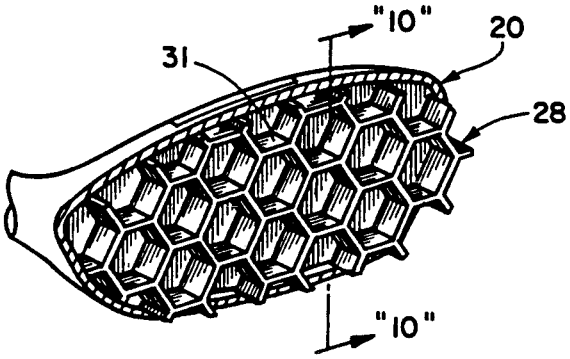
FIG. 9 is a perspective fragmentary view of the club head body illustrated in FIGS. 1 to 8.

Club head 10 includes a body 12 and a bottom plate 13 both stainless steel investment castings that are joined together at parting line 15 by heliarc welding (See FIG. 8). The resulting weldment at line 15 is thereafter ground and the club head finished.

Figure 10:
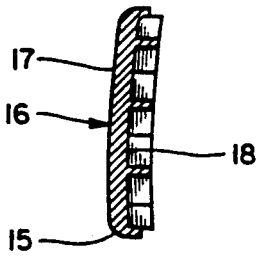
FIG. 10 is a fragmentary section taken generally along line 10—10 of FIG. 9.

Body 12 includes a forward ball striking wall 16 having a forward face 17 and a rear face 18 (See FIG. 10). Forward face 17 and rear face 18 are parallel and spaced apart so that the forward wall 16 has a thickness of approximately 0.050 to 0.100 inches, which is significantly lower than contemporary stainless steel perimeter-weighted investment cast club faces that have no infra structure.

The forward wall 16 is surrounded in part by a perimeter rearwardly extending wall 20 having a top wall 21, a left side wall 23, and a right side wall 25. A hosel 26 projects upwardly from top wall 21 in conventional fashion. The perimeter wall 20 has a thickness in the range of 0.040 to 0.065 inches. Bottom plate 13 is somewhat thicker than the perimeter wall to lower the head center of gravity.

The interior of the perimeter wall 20 has a labyrinth of partitions 28 in the form of a hexagonal complex of stainless steel walls investment cast integrally with both forward wall 16 and perimeter wall 20 providing an extremely solid and rigid structure. The labyrinth of partitions 28 is comprised of a plurality of individual flat rectangular wall portions 31 having a thickness on the order of 0.015 to 0.040 and an orthogonal length of approximately 0.025 inches both in a plane parallel to face 16, and a length normal to face 16 in the range of 0.040 to 0.250 inches. The wall thickness of segments or wall portions 31 can be controlled and varied as can the length of the wall portions normal to the forward wall 16 to vary head weight and reinforcement benefits.

In the investment casting process for body 20, the core pieces forming the partitions 28, the interior of perimeter wall 20, and the rear surface 18 of forward wall 16, collapse at certain points around the walls to clear any undercuts in the walls and then are withdrawn or pulled downwardly from the labyrinth and the perimeter wall. Thereafter, the bottom plate 13 is welded to the body, the body is filled with a urethane foam, closed and the club head finished.

Figure 3:
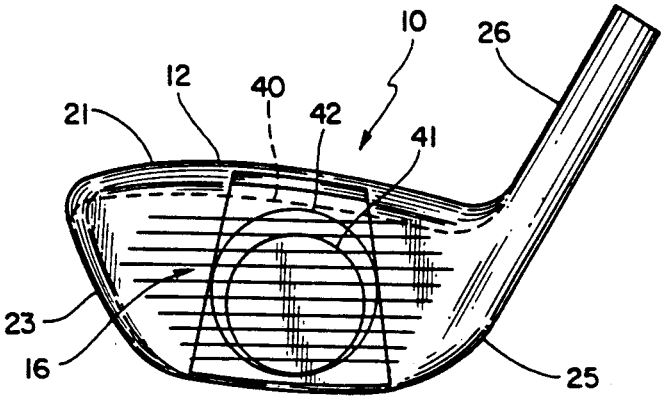
FIG. 3 is a front view of the club head illustrated in FIG. 1.
Figure 4:
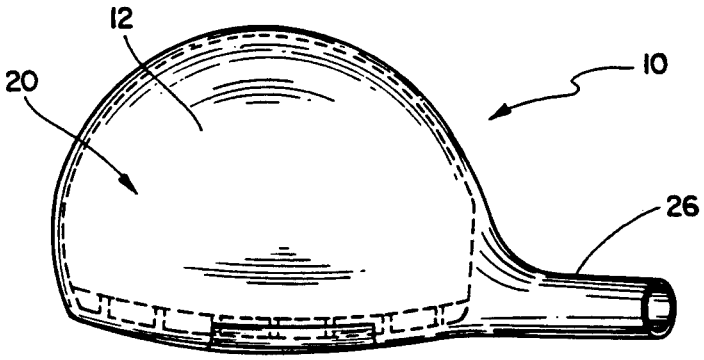
FIG. 4 is a top view of the club head illustrated in FIG. 1.
Figure 5:
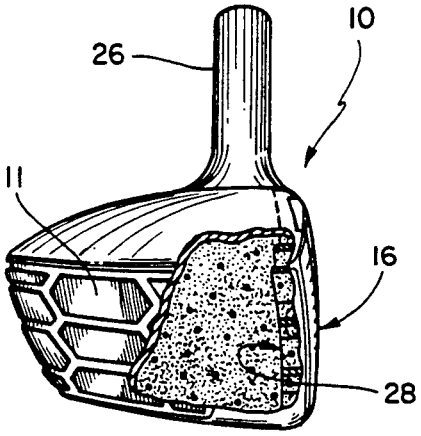
FIG. 5 is a left side view of the club head shown in FIG. 1, partly broken away to show its interior.
Figure 6:
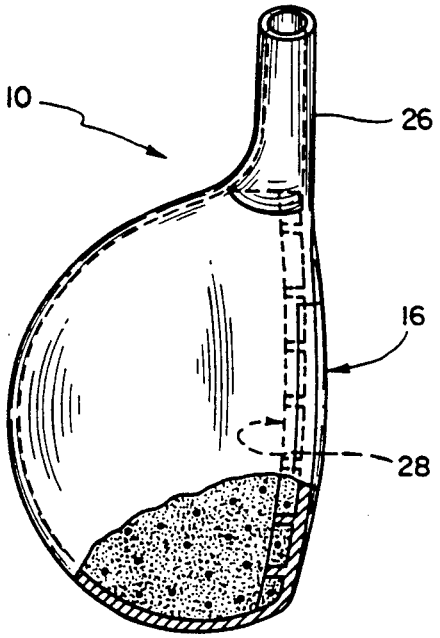
FIG. 6 is a top view of the club head shown in FIG. 1, partly broken away to show its interior.
Figure 7:
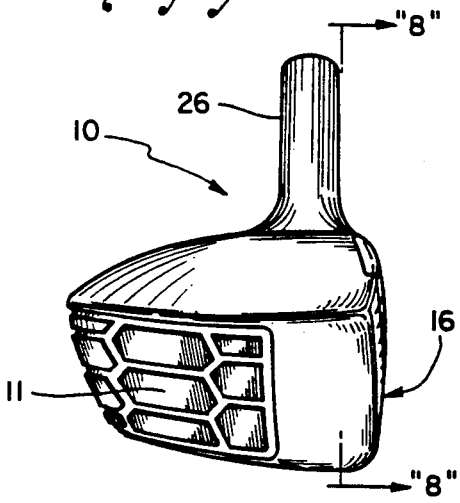
FIG. 7 is a left side view similar to FIG. 5.

Viewing FIG. 3, the top of a conventional front wall is indicated by the dotted line 40. Face wall 16 has a vertical height in the plane of FIG. 3 of 1.625 to 1.72 inches compared to conventional metal wood heads that have face heights significantly less (in terms of head design) than 1.500 inches. The sweetspot of head 10 is indicated by circle 42 while the conventional head sweetspot by the circle 41. The sweetspot 42 is larger than sweetspot 41 by a factor greater than the percent increase in total face area of face 16 over the area of the face indicated by line 40.

I claim:

1. A metal wood golf club assembly, comprising: a hollow metallic cast head having an enlarged predetermined area face wall including an enlarged sweet spot and an enclosing perimeter wall having a substantially flat bottom wall portion defining a hollow interior cavity, a shaft connected to the head, the right of said face wall being at least 1.625 inches and a unit cellular structure cast integrally with and projecting rearwardly from the face wall, said unit cellular structure including a plurality of unit cells defined by boundary walls surrounded by other cells wherein the average diameter of each cell is substantially greater than the cross-sectional thickness of the boundary walls in a plane parallel to the face wall, and the area of said enlarged sweet spot being greater in proportion relative to said enlarged face wall predetermined area than in a similar hollow metallic cast head having a sweetspot area, a face wall height substantially less than 1.625 inches and a face all area substantially less than said enlarged face wall predetermined area.

2. A metal wood golf club assembly as defined in claim 1, wherein the head is investment cast and the face wall has a thickness less than 0.125 inches.

3. A metal wood golf club assembly as defined in claim 1, wherein the head is investment cast stainless steel.

4. A metal wood golf club assembly as defined in claim 1, wherein the perimeter wall is generally cup-shaped and has an average wall thickness of approximately 0.030 to 0.060 inches.

5. A metal wood golf club assembly as defined in claim 1, wherein there are at least twelve unit cells the outermost of which are bounded in part by the perimeter wall.

6. A metal wood golf club assembly as defined in claim 5, wherein the unit cells are hexagonal in configuration.

7. A metal wood golf club assembly as defined in claim 1, wherein the boundary walls have a substantially uniform cross sectional thickness in a direction parallel to the face wall.

8. A metal wood golf club assembly, comprising: a hollow metallic cast head having an enlarged predetermined area face wall including an enlarged sweet spot and an enclosing perimeter wall having a substantially flat bottom wall portion defining a hollow interior cavity wherein the face wall has a thickness less than 0.125 inches and the perimeter wall has a lesser thickness, a shaft connected to the head, said face wall having a height of at least 1.625 inches and a unit cellular structure cast integrally with and projecting rearwardly from the face wall, said unit cellular structure including a plurality of unit cells defined by boundary walls surrounded by other cells wherein the average diameter of each cell is substantially greater than the cross-sectional thickness of the walls in a plane parallel to the face wall, the boundary walls having a substantially uniform cross sectional thickness in the plane parallel to the face wall, and the area of said enlarged sweet spot being greater in proportion relative to said enlarged face wall predetermined area than in a similar hollow metallic cast head having a sweetspot area, a face wall height substantially less than 1.625 inches and a face wall area substantially less than said enlarged face wall predetermined area.

9. A metal wood golf club assembly, comprising: a hollow metallic cast head having an enlarged predetermined area face wall including an enlarged sweet spot and an enclosing perimeter wall having a substantially flat bottom wall portion defining a hollow interior cavity wherein the face wall has a thickness significantly less than 0.125 inches and the perimeter wall has a lesser thickness, a shaft connected to the head, the height of said face wall being in the range of 1.625 to 1.720 inches and a unit cellular structure cast integrally with and projecting rearwardly from the face wall, said unit cellular structure including a plurality of unit cells defined by boundary walls surrounded by other cells wherein the average diameter of each cell is substantially greater than the cross-sectional thickness of the walls in a plane parallel to the face wall, the boundary walls having a substantially uniform cross sectional thickness in the plane parallel to the face wall, there being at least twelve unit cells the outermost of which are bounded in part by the perimeter wall, and the area of said enlarged sweet spot being greater in proportion relative to said enlarged face wall predetermined area than in a similar hollow metallic cast head having a sweetspot area, a face wall height substantially less than 1.625 inches and a face wall area substantially less than said enlarged face wall predetermined area.

* * * * *